United States Patent [19]

Zerbe

[11] 4,403,457

[45] Sep. 13, 1983

[54] APPARATUS FOR SUPPORTING PORTABLE HAND TOOLS

[76] Inventor: Lowell B. Zerbe, 317 Sunset Dr., Columbus, Ind. 47201

[21] Appl. No.: 232,399

[22] Filed: Feb. 9, 1981

[51] Int. Cl.[3] ..... B24B 23/02

[52] U.S. Cl. ..... 51/170 T; 144/134 D; 144/136 C

[58] Field of Search ..... 51/166 R, 166 TS, 170 T, 51/241 R; 144/1 E, 1 F, 134 D, 136 C, 119 R; 409/182

[56] References Cited

U.S. PATENT DOCUMENTS

| | | | |
|---|---|---|---|
| 2,888,965 | 6/1959 | Phillips | 144/136 C |
| 3,087,520 | 4/1963 | Fielder | 144/136 C |
| 3,162,221 | 12/1964 | Lacey | 144/134 D |
| 3,179,136 | 4/1965 | De Santis | 144/134 D |
| 3,288,183 | 11/1966 | Eisbrenner | 144/136 C |
| 3,762,452 | 10/1973 | Bernald | 144/134 D |
| 3,853,160 | 12/1974 | Posey | 144/136 C |

*Primary Examiner*—Harold D. Whitehead
*Assistant Examiner*—K. Bradford Adolphson
*Attorney, Agent, or Firm*—Barnes & Thornburg

[57] ABSTRACT

A portable hand tool, such as a drill, having an outer casing and a chuck adapted to receive a tool attachment is supported to facilitate handling of the tool. An apparatus for supporting the tool includes a base having an opening for receiving the tool attachment, a guide member spanning the base opening also including an opening for receiving the chuck, and an adjustable bushing for changing the size of the guide member opening for different size tools. Tracks are provided on the base for guiding movable brackets into engagement with the tool casing to support the tool. The brackets are secured in engagement with the tool casing by adjustable bands, and are secured in positions relative to the tracks by removable handles which are used to hold the apparatus.

12 Claims, 4 Drawing Figures

FIG. 1
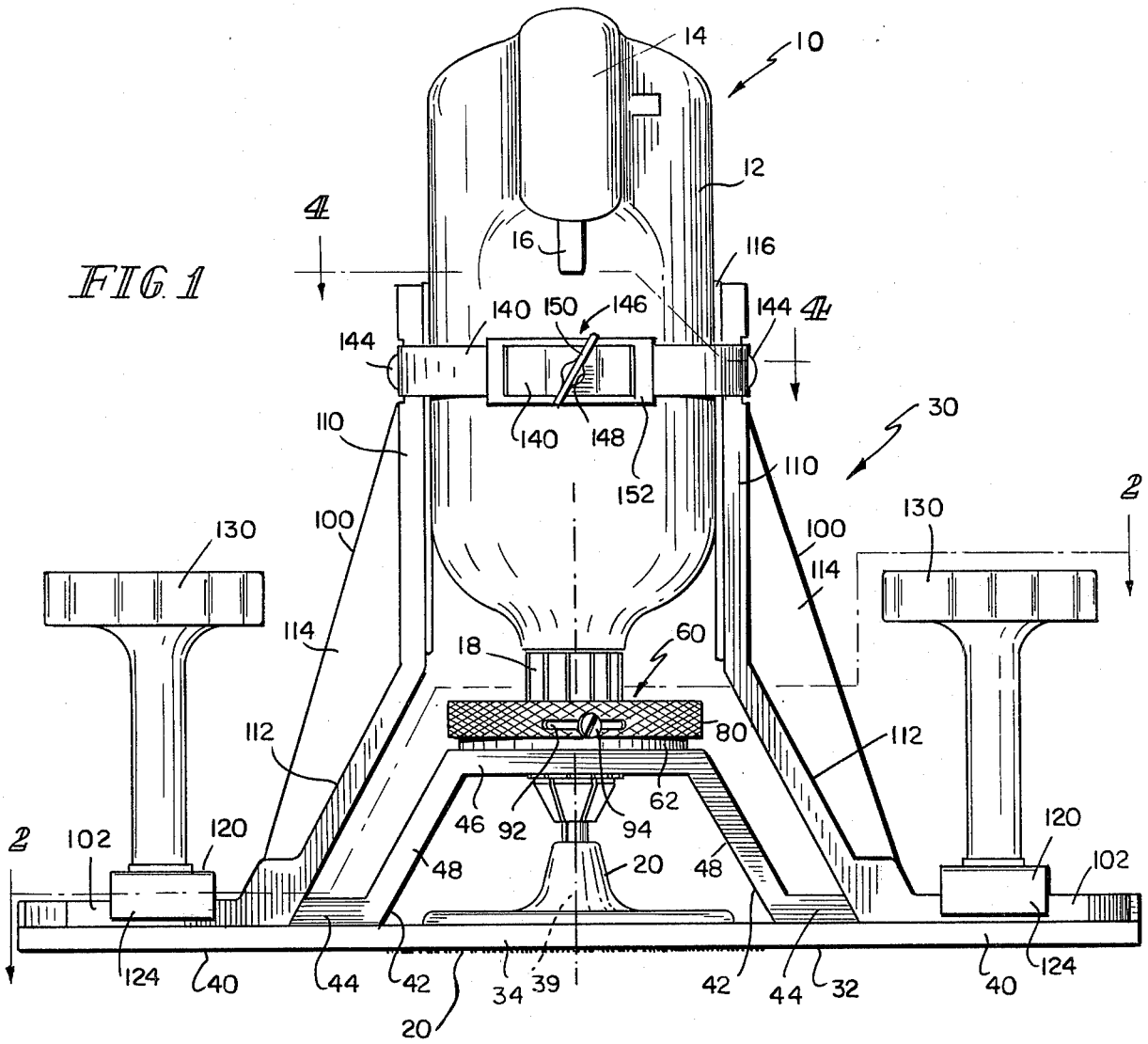
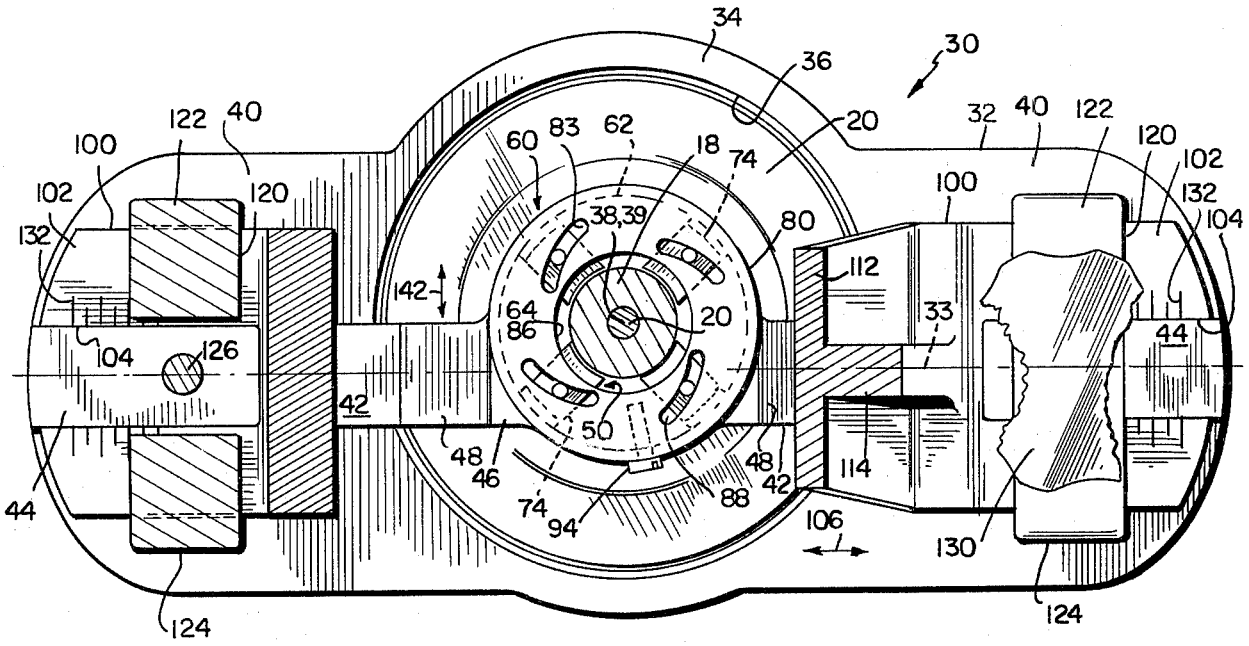
FIG. 2

APPARATUS FOR SUPPORTING PORTABLE HAND TOOLS

BACKGROUND OF THE INVENTION

1. Field of the Invention

The present invention relates to attachments for portable hand tools which facilitate the handling of the tool and is more particularly concerned with an improved apparatus for supporting the hand tool which is versatile and easy to attach when converting the tool to other uses.

2. Description of the Invention

Portable hand tools are generally designed for a particular use. For example, a portable drill is designed for boring holes into wood, metal, or other materials. Because of the similarities of the structure and operation of many hand tools, a portable drill may come equipped with a bit fitted with a sanding pad to allow the drill to be used as a sander. However, in converting a power drill to a sander, a problem occurs in trying to hold the drill while performing the sanding operation. The sanding pad has substantially greater surface area which creates substantial friction with the work surface. This friction creates a greater amount of torque on the drill housing than when the drill is used to bore holes. Because of the handle design of the drill, this greater torque may jerk the drill from the user's grasp. Furthermore, it is difficult to maintain constant pressure on the entire surface of the sanding pad to achieve a constant sanding pattern on the work surface.

Some previous efforts have been made to provide attachments for portable power-driven tools or machines to facilitate the handling, control, and positioning of the tool when converted from its conventional use to another use. For example, U.S. Pat. No. 1,882,705 discloses a support or handle for portable power-driven tools or machines which are designed for rubbing, polishing, sanding, and the like. U.S. Pat. Nos. 3,162,221 and 3,762,452 disclose attachments for converting a portable power-driven drill for use as a router.

SUMMARY OF THE INVENTION

The present invention provides an improved apparatus which is inexpensive and simple to attach to the portable tool.

It is one object of the present invention to provide an apparatus for supporting a portable power-driven drill for use as a sander.

Another object of the present invention is to provide an apparatus for supporting a portable tool which is adaptable to various-sized tools and which can be easily and quickly attached to and removed from the tools.

A further object is to provide an apparatus for supporting a portable tool which is lightweight and which includes handles to facilitate control and positioning of the tool during operation.

Various other features and advantages of the present invention will become apparent in view of the following detailed description of one embodiment thereof, which description should be considered in conjunction with the accompanying drawings, in which:

BRIEF DESCRIPTION OF THE DRAWINGS

FIG. 1 is a side elevational view of an apparatus according to the present invention shown supporting a power-driven portable drill;

FIG. 2 is a transverse view, partly cross-sectioned and partly broken away, of the apparatus shown in FIG. 1, taken generally along section lines 2—2 in FIG. 1;

DESCRIPTION OF THE PREFERRED EMBODIMENTS

Figure 4:
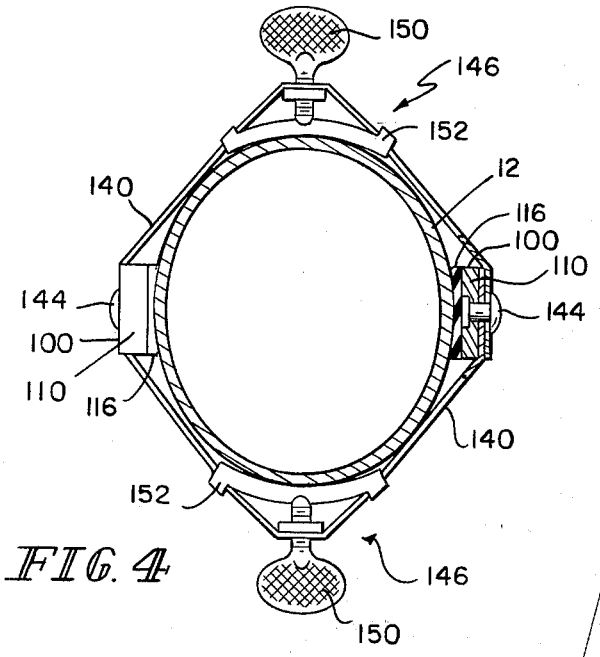
FIG. 4 is a transverse view, partly cross-sectioned, of the apparatus shown in FIG. 1, taken generally along section lines 4—4 in FIG. 1.

Referring now to FIG. 1, the present invention is shown attached to a portable power-driven tool 10, such as a portable drill, having a generally cylindrical outer casing 12 and a handle or grip 14 extending radially outwardly from the casing 12. A conventional trigger switch 16 is shown in a normal position relative to the casing 12 and handle 14. The distal end of the casing 12 includes an offset axially extending chuck 18 adaptable for holding a tool attachment 20, such as the bit of a drill or sanding pad. While the present invention is described in relation to a portable drill 10 having a sanding pad 20 attached to the chuck 18, it can be appreciated that the invention may be adapted to various other power-driven portable tools of various sizes having features similar to the drill 10.

Referring to FIGS. 1 and 2, the apparatus 30 of the present invention is designed to support the portable tool 10 at generally a right angle to a work surface (not shown). The apparatus 30 includes an elongated, substantially planar base member 32 having a central longitudinal axis 33 (FIG. 2). Base 32 may be constructed of wood, metal, or other rigid materials. The base member 32 includes a central section 34 having generally arcuate outer edges. A circular opening 36 is formed in the central section 34 and has a center 38 located on a central axis 39 (FIG. 1) of the opening 36. As best shown in FIG. 2, the central axis 39 of opening 36 is laterally located in spaced relationship to the longitudinal axis 33 of the base member 32. This relationship of the central axis 39 of the opening 36 and the longitudinal axis 33 of the base member 32 is provided to compensate for the offset position of the chuck 18 of the drill 10. In a preferred embodiment, the opening 36 has a diameter of 5.5 inches (13.97 cm) which will accommodate the pad of a standard sander attachment 20.

The base member 32 also includes two generally rectangular outer sections 40 which extend outwardly from the central section 34 in opposed directions. An elongated guide member 42 is permanently mounted to the base member 32 on the central longitudinal axis 33 of the base member 32. The guide member 42 includes two narrow track sections 44 which are secured to the rectangular outer sections 40 of the base member 32. A bridge section 46 is elevated in spaced relationship above the opening 36 by intermediate sections 48 which extend angularly upwardly from the track sections 44. Bridge section 46 spans the opening 36 and includes a circular opening 50 which is concentric to opening 36. Opening 50 has a diameter which is generally less than the diameter of the opening 36, and provides a guide for the chuck 18 of the drill 10. The center of opening 50 is also located on the central axis 39 of the opening 36 in the base member 32.

Figure 3:
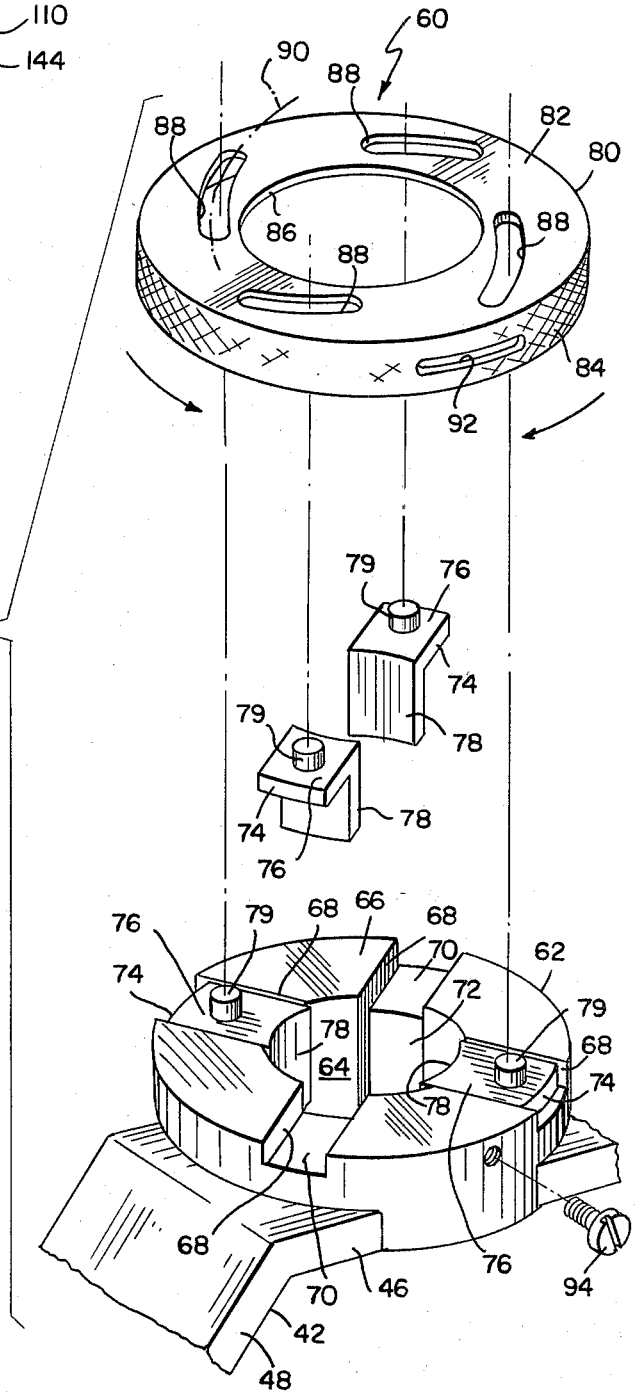
FIG. 3 is an exploded perspective view of a section of the apparatus shown in FIG. 1.

Referring particularly to FIG. 3, an adjustable bushing 60 is mounted to the bridge section 46 of the guide member 42 for varying the size of the opening 50 to adapt the apparatus 30 to drills 10 having various-sized chucks 18. In the preferred embodiment, the bushing 60 is adjustable for chucks 18 of standard ¼ inch (0.635 cm) and ⅜ inch (0.953 cm) drills 10. The bushing 60 includes a cylindrical base 62 which may be constructed of metal. Base 62 is mounted to the bridge section 46 of the guide member 42 adjacent the opening 50. A circular opening 64 is formed in the base 62 and, when mounted to the bridge section 46, the opening 64 is concentric with the openings 36, 50 so that the center of opening 64 is located on the central axis 39 of the opening 36. Opening 64 has a diameter which is either equal to or less than the diameter of the opening 50.

The base 62 of the bushing 60 includes four equidistant radially spaced grooves 68. Each groove 68 includes a radially extending portion 70 formed in the top surface 66 of the base 62 and an axially extending arcuate portion 72 formed in the axially extending surface of the opening 64. The axially extending portions 72 of the grooves 68 have a curved shape which generally corresponds to an arc of the circular opening 64.

Four radially adjustable fingers 74 are slidably received in the grooves 68. Each finger 74 is generally L-shaped in cross section and includes a radially extending portion 76 corresponding to the radially extending portion 70 of grooves 68 and an axially extending arcuate portion 78 corresponding to the axially extending arcuate portion 72 of the grooves 68. A boss 79 projects upwardly from each of the fingers 74 and is employed to move the fingers 74 radially inwardly and outwardly relative to the central axis 39 of the opening 36.

Continuing to refer to FIG. 3, a circular adjustment plate 80 having an outer diameter slightly greater than the outer diameter of the cylindrical base 62 is rotatably received on the base 62. The adjustment plate 80 has a top surface 82 and a circumferential skirt 84 depending downwardly around the periphery of the top surface 82. As shown in FIG. 3, the skirt 84 is knurled to provide a grip for rotation of the plate 80 on the base 62. The plate 80 further includes a central circular opening 86 so that when plate 80 is received on base 62, the opening 86 is concentric to openings 36, 50, and 64. Therefore, opening 86 also has its center located on the central axis 39 of the opening 36. Opening 86 has a diameter which is generally the same as the diameter of opening 64 of the base 62.

Four inwardly curving slots 88 are formed in the top surface 82 of the adjustment plate 80 for slidably receiving the bosses 79 which project upwardly from the fingers 74. Each inwardly curving slot 88 is struck along an arc 90 of a circle which is eccentric to the circular openings 36, 50, 64, and 86. A slot 92 is also formed circumferentially in the downwardly depending skirt 84 for receiving an adjustment screw 94 which is threaded through the slot 92 into the base 62.

In operation of the bushing 60, the adjustment plate 80 is rotated in a clockwise direction, as indicated by the arrow in FIG. 3, to simultaneously move fingers 74 radially inward toward the center of the opening 64 in the base 62 to reduce the size of opening 64 and the corresponding opening 50 in the bridge section 46 of the guide member 42. Plate 80 is rotated in a counterclockwise direction, as indicated by the arrow in FIG. 3, to simultaneously move the fingers 74 radially outward away from the center of the opening 64 to enlarge the opening 64 and the corresponding opening 50 in the bridge section 46 of the guide member 42. Once the desired size for opening 50 has been determined by the bushing 60 so that chuck 18 is freely rotatable within the openings 50 and 64, adjustment screw 94 is tightened to secure the adjustment plate 80 in position in order to maintain the radial position of the fingers 74. Fingers 74 restrict lateral movement of the chuck 18 during the operation of the drill 10.

Returning to FIGS. 1 and 2, two support brackets 100 are movably carried in opposed relationship on the base member 32, and each includes a generally planar channel section 102. Each channel section 102 includes a channel 104 for slidably engaging a track section 44 of the guide member 42. Track sections 44 guide the movement of support brackets 100 in directions toward and away from openings 36, 50, as indicated by the arrow 106 in FIG. 2, along the longitudinal axis 33 of the base member 32.

Each support bracket 100 includes an upwardly extending arm 110 for engaging the outer casing 12 of the drill 10. Each arm 110 is connected to a channel section 102 by an intermediate section 112 which extends angularly upwardly from the channel section 102. The arm 110 and the channel section 102 are also interconnected by a reinforcing brace 114 to increase the strength and rigidity of the arm 110. As most particularly shown in FIG. 4, the inner surface of each of the arms 110 is covered by a strip of pliable material 116, such as rubber, for engaging the outer casing 12 of the drill 10.

Continuing to refer to FIGS. 1 and 2, movable support brackets 100 are secured in selected positions relative to the track sections 44 of the guide member 42 by C-clamps 120. Each C-clamp 120 has a generally rectangular portion 122 and flanges 124 depending downwardly from the ends of the rectangular portion 122 for engaging the channel sections 102 of the brackets 100. Mounting screws 126 project upwardly through the base member 32 and each of the track sections 44 of the guide member 42. The rectangular portions 122 of the C-clamps 120 include an aperture (not shown) for receiving the mounting screws 126. Handles or knobs 130 are threaded onto the mounting screws 126 and tightened against the C-clamps 120 to secure the channel sections 102 of the support brackets 100 to the base member 32. Calibrated adjustment scales 132 may be provided on either the channel sections 102 or the track sections 44 adjacent the channels 104 in order to assure that the support brackets 100 are symmetrically positioned on the base member 32 relative to the central axis 39 of the opening 36.

Referring to FIGS. 1 and 4, two adjustable bands 140 are connected to the arms 110 of the support brackets 100 in opposed relationship to clamp the two arms 110 into engagement with the outer casing 12 of the drill 10 and to further prevent movement of the drill 10 in the directions of the arrow 142 in FIG. 2. Bands 140 may be connected to the arms 110 by conventional means 144 such as screws or rivets.

Referring more particularly to FIG. 4, each band 140 includes an adjustment member 146 for adjusting the lengths of the bands 140 to tighten and loosen engagement with the casing 12. Each adjustment member 146 includes a threaded aperture 148 formed in the band 140 and an adjustment screw 150 threadably received in the aperture 148. Each band 140 is threaded through a buckle 152 which engages the casing 12 and which further serves as a surface for engaging the screws 150 to tighten the band 140.

As can be appreciated from the illustrative embodiment, the apparatus 30 can be easily attached to and removed from the drill 10 using only a screw driver.

The drill 10 is inserted axially between the bands 140 and positioned so that the bottom of the sander attachment 20 projects slightly beyond the bottom of the base member 32 and further so that the axis of the bit of the sander attachment 20 is generally aligned with the central axis 39 of the opening 36. By adjusting the bushing 60, the size of the opening 50 of the guide member 42 is increased or decreased so that the fingers 74 are in close proximity to the chuck 18 to prevent lateral movement of the chuck 18 during the operation of the drill 10. Once the bushing 60 has been adjusted, the adjustment screw 94 is tightened with the screw driver to fix the radial position of the fingers 74 and the size of the openings 50 and 64. Further positioning and engagement of the casing 12 is accomplished by turning the adjustment screws 150 provided on the bands 140 to tighten or loosen each band 140. With the drill 10 supported in the apparatus 30, the user can control and position the drill relative to a work surface (not shown) by grasping the handles 130. Handles 130 give the user two points of control in place of the single control handle 14 provided on the outer casing 12 of the drill 10.

What is claimed is:

1. Apparatus for supporting a portable tool of the type having an outer casing and a chuck adapted to receive a tool attachment, comprising a base member having a longitudinal axis, a first opening formed in the base member and having a central axis at generally a right angle to the longitudinal axis of the base member, a guide member mounted on the base member, the guide member including a bridge section in spaced relationship to the first opening, a second opening formed in the bridge section having a center generally located on the central axis of the first opening, an adjustment member on the bridge section providing at least one groove extending radially with respect to the second opening, at least one finger radially movable in the groove into close proximity to the chuck, means for moving the finger to adjust the size of the second opening to receive chucks of various sizes, the bracket means for engaging the casing to support the tool, the bracket means being movable on the base member to adjust the position of the tool relative to the central axis of the first opening, and means for securing the bracket means to the base member in selected positions to support the tool.

2. The apparatus of claim 1 wherein the guide member includes a pair of track sections extending outwardly from the bridge section in opposed directions on the longitudinal axis of the base member, and a pair of intermediate sections connecting the track sections to the bridge section, the intermediate sections extending upwardly from the track sections to elevate the bridge section above the first opening.

3. The apparatus of claim 2 wherein the bracket means includes a pair of support brackets, each support bracket including a channel for slidably engaging a track section of the guide member and an upwardly extending arm for engaging the tool casing, the support bracket being movable in directions parallel to the longitudinal axis of the base member.

4. The apparatus of claim 3 wherein the securing means includes first clamping means for securing the support brackets in selected positions relative to the track sections of the guide member.

5. The apparatus of claim 4 wherein the first clamping means includes a pair of C-clamps for engaging the support brackets and the tracks, and a pair of handles for tightening the C-clamps on the support brackets and tracks.

6. The apparatus of claim 4 further comprising second clamping means for securing the arms of the brackets to the tool casing, the second clamping means includes a pair of bands connecting the arms and encompassing the tool casing, and means for adjusting the bands to draw the arms into engagement with the tool casing and to move the casing in directions transverse to the longitudinal axis of the base member.

7. Apparatus for supporting a portable tool of the type having an outer casing and a chuck adapted to receive a tool attachment, comprising a base member having a longitudinal axis, a first opening formed in the base member and having a central axis at generally a right angle to the longitudinal axis of the base member, a guide member mounted on the base member, the guide member including a bridge section in spaced relationship to the first opening, a second opening formed in the bridge section having a center generally located on the central axis of the first opening, means for adjusting the size of the second opening to receive chucks of various sizes, the adjusting means including a base mounted on the bridge section, the base including at least one groove extending radially with respect to the second opening, at least one finger radially movable in the groove into close proximity to the chuck, the finger including an upwardly extending boss for moving the finger, bracket means for engaging the casing to support the tool, the bracket means being movable on the base member in directions parallel to the longitudinal axis of the base member to position the tool relative to the central axis of the first opening, and means for securing the bracket means to the base member in selected positions to support the tool.

8. The apparatus of claim 7 wherein the central axis of the first opening is laterally located in spaced relationship to the longitudinal axis of the base member.

9. The apparatus of claim 8 wherein the means for adjusting the size of the second opening further includes an adjustment plate rotatably received on the base of the adjusting means, the adjustment plate includes at least one inwardly curved slot for receiving the boss of the finger, rotation of the adjustment plate in a first direction moving the finger radially inward, and rotation of the adjustment plate in a second direction moving the finger radially outward.

10. The apparatus of claim 9 wherein the adjustment plate further includes a downwardly depending skirt encompassing the base of the adjusting means, the skirt includes a circumferentially extending slot and means for engaging the slot to secure the adjustment plate in position relative to the base.

11. Apparatus for supporting a portable tool of the type having a chuck adapted to receive a tool attachment, comprising a base platform having a longitudinal axis, a first generally circular opening formed in the platform and having a central axis at generally a right angle to the longitudinal axis of the platform, a guide member provided on the platform, the guide member including a pair of track sections on the platform and a bridge section in spaced relationship to the first opening, the track sections extending outwardly from the bridge section in opposed directions on the longitudinal axis of the base member, a pair of intermediate sections connecting the track sections to the bridge section to elevate the bridge section above the first opening, a second generally circular opening formed in the bridge section and being concentric to the first opening, means for adjusting the size of the second opening to receive chucks of various sizes, a pair of movable brackets for supporting the tool, each bracket including a channel for slidably engaging one of the track sections of the guide member and an upwardly extending arm for engaging the tool, means for securing each bracket to the platform in selected positions along the track sections of the guide member, and means for adjustably clamping the arms of the brackets into engagement with the tool.

12. An apparatus for use in converting a hand drill to a sander, the drill including a casing and a chuck adapted to receive the bit of a sander attachment, the apparatus comprising an elongated base member, a first circular opening formed in the base member and having its center located off the longitudinal axis of the base member for receiving the sander attachment, a guide member on the base member, the guide member including a bridge section in spaced relationship to the first opening, a second circular opening formed in the the bridge section concentric with the first opening, an adjustment member on the bridge section providing at least one groove extending radially with respect to the second opening, at least one finger radially movable in the groove into close proximity to the chuck, means for moving the finger to adjust the size of the second opening to receive chucks of various sizes, bracket means movably carried on the base member for engaging the casing to support the drill, the guide member including means for guiding the movement of the bracket means in directions parallel to the longitudinal axis of the base member, and a pair of handles removably connected to the base member to lock the bracket means in selected positions in engagement with the casing and to provide means for handling, controlling, and positioning the drill in a sanding operation.

* * * * *